US006957974B2

(12) United States Patent
Bruski et al.

(10) Patent No.: US 6,957,974 B2
(45) **Date of Patent: *Oct. 25, 2005**

(54) SYSTEM FOR PROVIDING DATA AND POWER SIGNALS TO NETWORKED DEVICES

(75) Inventors: Gary P. Bruski, Germantown, WI (US); G. Erich Heberlein, Jr., Oconomowoc, WI (US); Sean V. Ciesielka, Elgin, IL (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/793,133

(22) Filed: Mar. 4, 2004

(65) Prior Publication Data

US 2005/0196998 A1 Sep. 8, 2005

Related U.S. Application Data

(62) Division of application No. 09/948,831, filed on Sep. 7, 2001, now Pat. No. 6,729,913.

(51) Int. Cl.[7] ..... H01R 13/625; H01R 4/50

(52) U.S. Cl. ..... 439/344; 439/676; 439/908

(58) Field of Search ..... 439/344–345, 439/676–677, 678, 884, 908, 954

(56) References Cited

U.S. PATENT DOCUMENTS

| | | | | |
|---|---|---|---|---|
| 5,484,303 | A * | 1/1996 | Cheng | 439/345 |
| 5,611,710 | A * | 3/1997 | Essrich | 439/513 |
| 5,689,242 | A | 11/1997 | Sims et al. | 340/652 |
| 5,743,750 | A | 4/1998 | Sullivan et al. | 439/76.1 |
| RE37,296 | E * | 7/2001 | Peterson | 439/677 |
| 6,261,124 | B1 | 7/2001 | Brock | 439/540.1 |
| 2005/0063535 | A1 * | 3/2005 | Walbeck et al. | 379/399.01 |

FOREIGN PATENT DOCUMENTS

| | | | |
|---|---|---|---|
| JP | 8-8952 | * | 1/1996 |
| WO | WO 00/11759 | * | 3/2000 |

* cited by examiner

*Primary Examiner*—Michael C. Zarroli
(74) *Attorney, Agent, or Firm*—Patrick S. Yoder; Alexander M. Gerasimow

(57) ABSTRACT

A connector system is provided in which a branch connector may be secured in a pre-wired power and data network. The branch connector is designed to interface with existing network connections to provide at least one additional interface point for added or temporary devices. The connector may be designed to interface with existing connectors in a manner similar to existing cable assemblies, and may present sockets or similar interfaces which are substantially identical to the interface to which the connector is applied. Expanded network connectivity is thus provided for additional devices or temporary devices, such as programming, logging, system configuration and troubleshooting, and similar applications.

20 Claims, 4 Drawing Sheets

SYSTEM FOR PROVIDING DATA AND POWER SIGNALS TO NETWORKED DEVICES

CROSS REFERENCE TO THE RELATED APPLICATIONS

The present application is a Divisional Application of U.S. Patent Ser. No. 09/948,831, filed Sep. 7, 2001, now U.S. Pat. No. 6,729,913, in the name of Gary P. Bruski et al., and entitled NETWORK BRANCH CONNECTOR AND METHOD AND SYSTEM INCORPORATING SAME.

BACKGROUND OF THE INVENTION

The present invention relates generally to the field of industrial control and monitoring networks, and to network connections within such environments. More particularly, the invention relates to a branch connector designed to permit devices to be coupled independently to a network for receiving control and monitoring signals, as well as power signals, without interruption of similar signals to other devices of the network.

A range of networks are known and are currently in use throughout industrial, consumer, and other applications. In many networks, data signals and power signals are transmitted separately to network devices. That is, the devices are coupled to computers or other data processing equipment or peripherals, and are separately coupled to a source of electrical power, such as a wall outlet. In industrial settings, specialized networks are often used which supply both data and power in a single set of connections. For example, in a network system of a current design, direct current power is available via a network cable, as are data signals. The cabling permits both power and data signals to be transmitted to and from the network devices. Thus, input and output modules can serve to apply control signals to network devices, or to receive feedback signals from the devices for carrying out complex control and monitoring functions.

In control and monitoring networks of the type described above, particular problems arise in the permanent or temporary addition of devices to the network. In a prefabricated enclosure, for example, specific connection points may be provided for the various original devices, with individual cable assemblies being routed from the connection points to the devices for normal operation. In general, it has been found desirable to route such cabling independently, so as to permit devices to be connected to the network or removed from the network without affecting application of power of data signals to downstream devices. However, after initial assembly or installation it may be found that an inadequate number of connection points may be available within the system or enclosure.

By way of example, when a new device or a temporary device is added to a control and monitoring network, a special connection may be required in addition to those already provided. The connection thus would require that the existing cabling be cut or tapped for terminating the new connector. Such procedures may be undesirable in settings where control and monitoring functions are carried on in real time and where making the connections may affect overall processes, such as manufacturing, material handling, and so forth. Certain industrial networks also enable monitoring functions to be carried out on temporarily connected devices, such as laptop computers, human interface modules, and the like. Where a connection is not available for such devices, however, a special connection may be installed as before, or one or more of the devices of the network may need to be disconnected to accommodate the temporary connection. Again, such interruption of service is often undesirable.

In addition to the foregoing considerations, certain enclosed systems, such as motor control centers, may include a series of bays with different types of equipment or networked devices installed in each bay. Certain of the devices may be coupled to higher voltages, such as for supplying power to specific loads controlled by the system. Even where additional connections are available in such bays, it may be desirable to add devices, or to service the system via temporary devices in a different bay where no additional connection is available.

There is a need, therefore, for a straightforward technique for accommodating additional or temporary connections in control and monitoring networks. There is a particular need for a connector system which will permit back-compatibility to existing systems, while enabling rapid and reliable connections to be made for additional or temporary devices without interrupting data and power signals to existing network devices.

SUMMARY OF THE INVENTION

The present invention provides novel branch connecting technique designed to respond to such needs. The technique may find a wide array of applications, but is particularly well-suited to industrial control and monitoring systems in which power and data signals are provided in a single cable to various network devices. The devices may include industrial controllers, input and output modules, actuators, switchgear, and so forth. The new technique allows for existing connection to the expanded to accommodate additional or temporary devices.

In an exemplary implementation, the system provides a connector in which a first connector portion or plug extends for mating connection with an existing socket or receptacle. The body further includes a pair of sockets or receptacles, which may be substantially similar or even identical to the receptacle with which the connector mates. Conductors within the connector or disposed to transmit both data and power signals between the network and the downstream devices ultimately connected to the additional connector. The power and data conductors are preferably laid out to avoid misalignment or erroneous connection. The connector system may also permit fasteners or other securement devices to be installed so as to prevent inadvertent removal of the connector system. The new or temporary devices can then be placed in communication with the network via the new connector, with at least one additional port being provided over and above the existing available connection.

The particular configuration of the plug and socket utilized in the branch connector of the present technique may be adapted for the particular environment, providing back-compatibility with existing systems. In general, the terms "plug" and "socket" or "receptacle" as used herein may extend to a wide range of configurations. In particular, while male and female connections may be utilized in a preferred embodiment, such terms may not be entirely accurate insomuch as a receptacle may include pins extending within a receptacle cavity, while a plug may include internal conductors designed to mate with such pins. In other configurations, the branch connector system may comprise hermaphroditic connections. In all configurations, however, the system permits expansion of an available number of ports or connections for temporary or permanent addition of a new device to the network.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
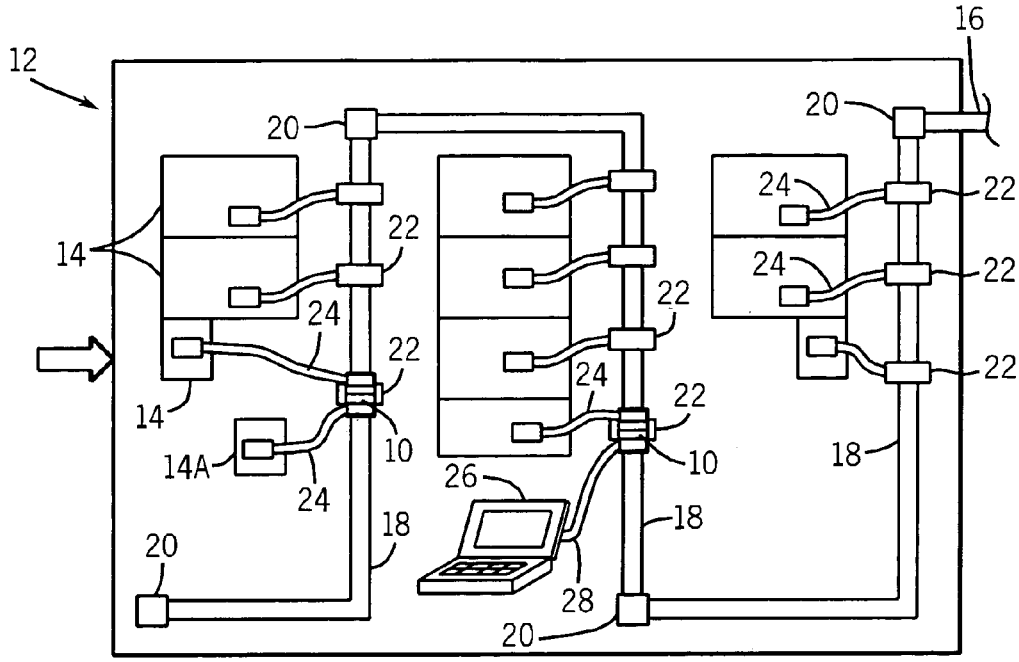
FIG. 1 is a diagrammatical representation of an industrial control and monitoring system, such as a motor control center, employing a range of network devices, as well as branch connectors for additional or temporary devices in accordance with the present technique.

Turning now to the drawings, and referring first to FIG. 1, a connector 10 is illustrated as applied to an industrial control and monitoring system, designated generally by reference numeral 12. In the illustrated embodiment, system 12 may comprise a motor control center, or other pre-wired system of components designed to carry out a specific control and monitoring function. As will be appreciated by those skilled in the art, such networks may typically include power supplies, industrial programmable logic controllers, input and output modules, actuators, switchgear, circuit protectors, and so forth. In a typical application, high voltage power will be applied to an enclosure in which the devices are mounted and pre-wired. The power is available to switchgear, motor starters and controllers, and other devices within the enclosure so as to permit low-level control signals to regulate application of electrical power to loads, such as electric motors. The system thus includes a range of devices 14, and may require additional or new devices as represented at reference numeral 14A.

In the system illustrated in FIG. 1, data and power signals for carrying out the control and monitoring functions of the various devices are supplied via an incoming cable 16. Cable 16 is connected to a series of distribution cables 18 which form both trunk sections and drop sections, interconnected with one another via mating connectors 20. Distribution connectors 22 mounted on cables 18 enable the devices to be connected to the network via individual device cable assemblies 24.

In a present implementation, cables 16 and 18 are flat cables enabling connections to be made via insulation displacement connectors. As will be appreciated by those skilled in the art, such connectors enable fast and reliable interconnection via conductors in the cable by piercing the outer insulating members of the cable to complete the desired connections. In the present implementation, cables 16 and 18 include a pair of power conductors flanking a pair of data signal conductors. The power conductors provide for distribution of the electrical power for devices 14, typically on the order of 24 VDC. The data conductors, which are at least partially shielded by the power conductors in the present implementation, afford transmission of data signals both to and from the devices, such as for application of control signals needed for carrying out the specific functions of the devices, and for receiving feedback signals on the state of various operation of parameters of the system. Data exchange over cables 16 and 18 may follow and suitable protocol, such as various industrial protocols for ensuring adequate exchange of data between the devices and external circuitry.

In the implementation illustrated in FIG. 1, and in a typical installation, specific connectors 22 will be provided at desired locations for interfacing with the devices 14. The cable assemblies 24 are interfaced with the connectors, and may also include pre-wired insulation displacement cable and connectors. Alternatively, jumper cables may be provided between the devices and connectors 22, or conductors of the cable assemblies may be terminated at the devices in a conventional manner.

To provide for expansion or permanent or temporary addition of devices to the network, branch connectors 10 are secured to certain of the connectors 22 within the system. Branch connectors 10 provide for permanent or temporary connection of devices to the network, while permitting the devices to be connected to the network and removed from the network without interruption of power or data signals to other devices. Moreover, the connectors facilitate expansion of available connection locations beyond those pre-wired in the system. In the embodiment illustrated in FIG. 1, for example, an additional device 14A is connected to the network via a first branch connector 10, while a portable monitor device, in a form of a laptop computer 26 is connected to a separate branch connector 10. The cable assemblies employed for interfacing the additional or temporary devices with the branch connector may be preformed or specifically adapted for the particular type of connection. For example, in the case of additional device 14A, a prefabricated device cable assembly 24 is installed. In the case the laptop computer 26, a specifically adapted cable assembly 28 is provided which offers at one end an interface for branch connector 10, and, at an opposite end, an interface for a compatible port connection of the laptop computer 26.

Figure 2:
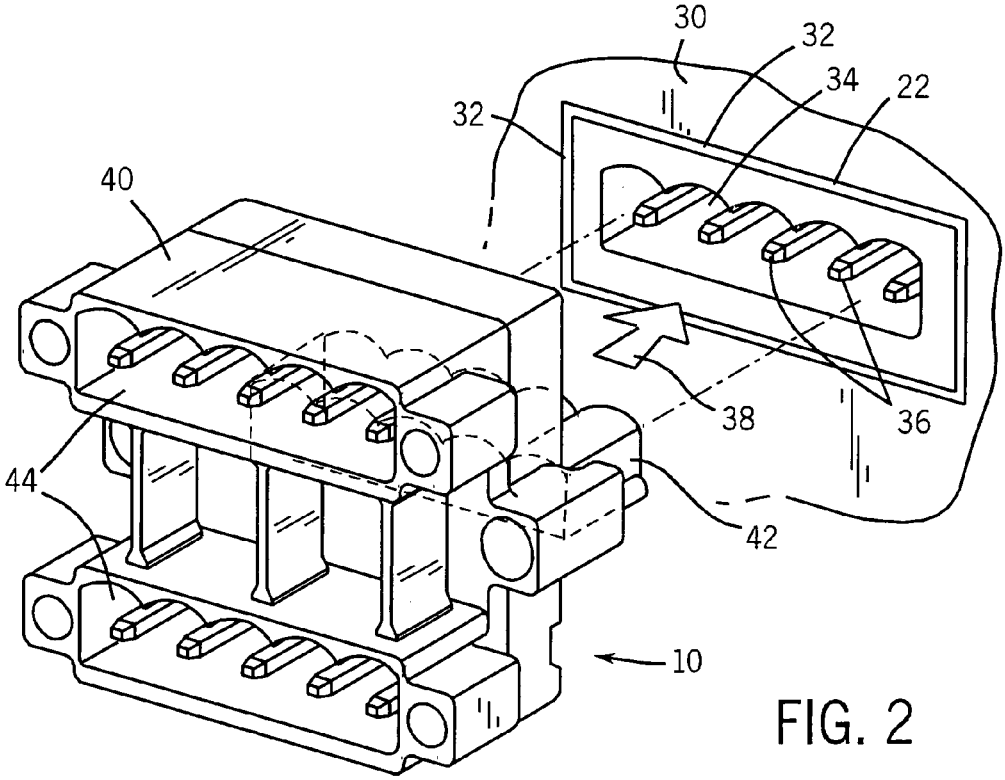
FIG. 2 is a perspective view of an exemplary branch connector for use in applications such as the system of FIG. 1.
Figure 3:
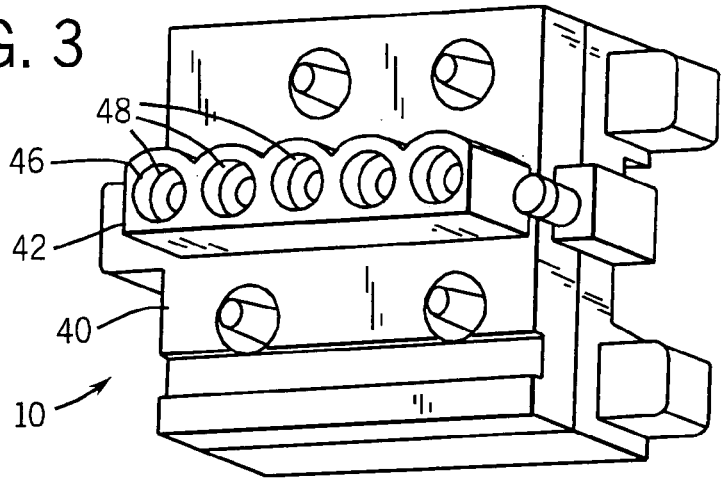
FIG. 3 is a rear perspective view of the branch connector shown in FIG. 2 illustrating an exemplary plug configuration.
Figure 4:
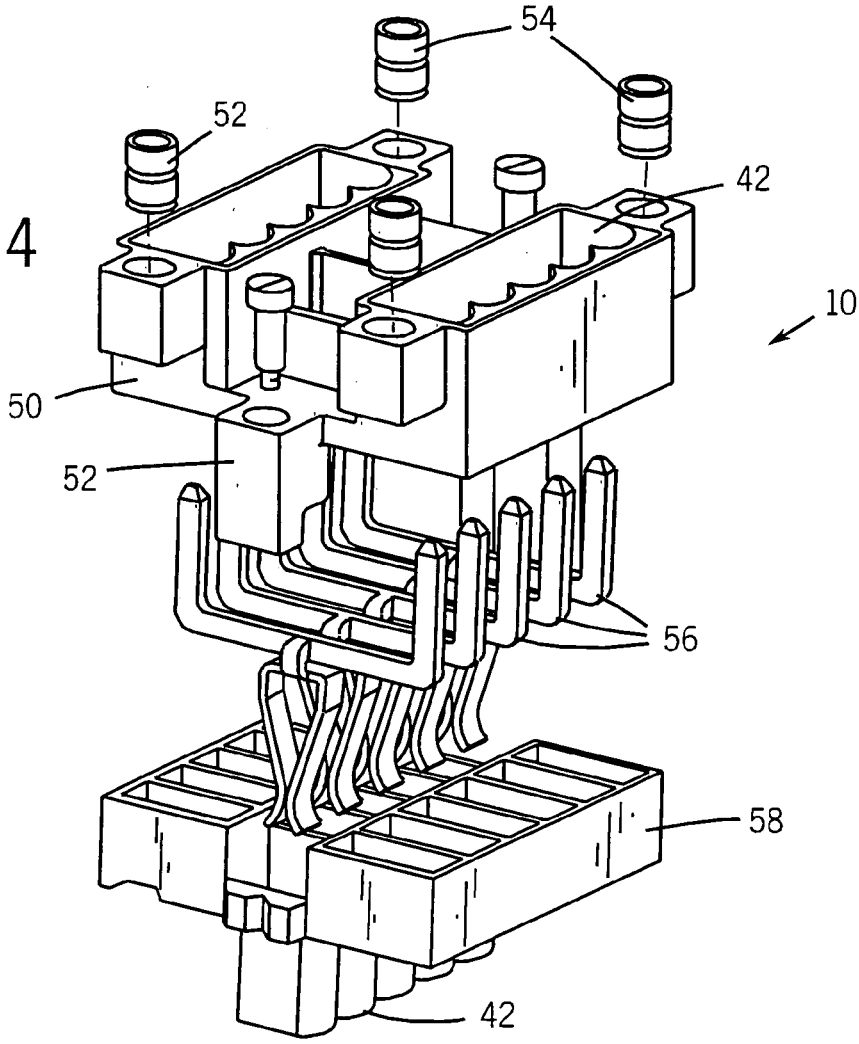
FIG. 4 is an exploded perspective view of the connector of FIGS. 2 and 3, illustrating the various components of the connector in an exemplary implementation.

Referring now more specifically to a present implementation of branch connector 10, an exemplary embodiment is illustrated in FIGS. 2, 3 and 4. As shown in FIG. 2, the branch connector 10 is adapted for interfacing with a distribution or device connector 22 in a system such as that illustrated in FIG. 1. In the illustrated embodiment, connector 22 is provided in a panel 30, which may be prefabricated with other connectors and cabling on a rear side of the panel. Retaining features 32, such as flanges, clips, and so forth, may be provided on the connector 22 to maintain its location within the panel 30. Connector 22 presents a socket or receptacle 34 in which a series of conductive pins 36 extend. It should be noted that, as used herein, the terms "socket", "receptacle" and "plug" may denote a wide range of arrangements in which male or female mechanical members present male pins or female conductors or other mating connections. For convenience, such terms are used to suggest the overall mechanical interfacing, although the socket 34 illustrated in FIG. 2 presents pins. Other arrangements, including hermaphroditic connector sockets and plugs, may also be envisioned.

As illustrated in FIG. 2, connector 10 may be interfaced with connector 22 as shown by arrow 38. In particular, connector 10 has a body 40 presenting an extension 42 designed to interface with socket 34. Features on the socket and on the extension ensure that correct orientation is provided. These orientation-sensitive features may include lobes as shown in FIG. 2 or other alignment devices. On an opposite side of body 40, connector 10 presents a pair of sockets 44 which may be generally similar to or, in the illustrated embodiment, identical to socket 34 of connector 22.

FIG. 3 illustrates a rear side of connector 10. As shown in FIG. 3, body 40 presents on its rear face extension 42 which is designed to interface with a socket such as socket 34 of connector 22 (see FIG. 2). The extension 42 includes a series of apertures 46 in which internal sidewalls 48 serve to protect and cover mating conductive elements as described below. In general, the connector is configured such that extension 42, which serves as a plug in the present implementation, is inserted into socket 34 (see FIG. 2) when the connector is mounted within the system.

FIG. 4 is a perspective exploded view of connector 10 in the implementation described above. As shown in FIG. 4, the body of the connector comprises a body base 50 which provides the mechanical structure for the sockets 44. A fastener extension 52 is provided in which fasteners, such as screws, bolts, clips, and the like may be secured for more permanently affixing the connector to the system, such as in threaded apertures of a connector or panel (not shown in the figures). Sleeves 54 are provided for receiving similar fasteners, where desired, such as for more permanently securing a cable assembly to connector 10 in application. Within the body base 50, conductive elements 56 are provided which complete connections between extension or plug 42 and sockets 44. The conductive elements 56 are captured within the body by a body cover 58 which is mechanically formed to present extension or plug 42. The body base 50 and the body cover 58 may be joined by any suitable means, such as via interfacing snap engagement, adhesive engagement, ultrasonic welding, and so forth.

Figure 5:
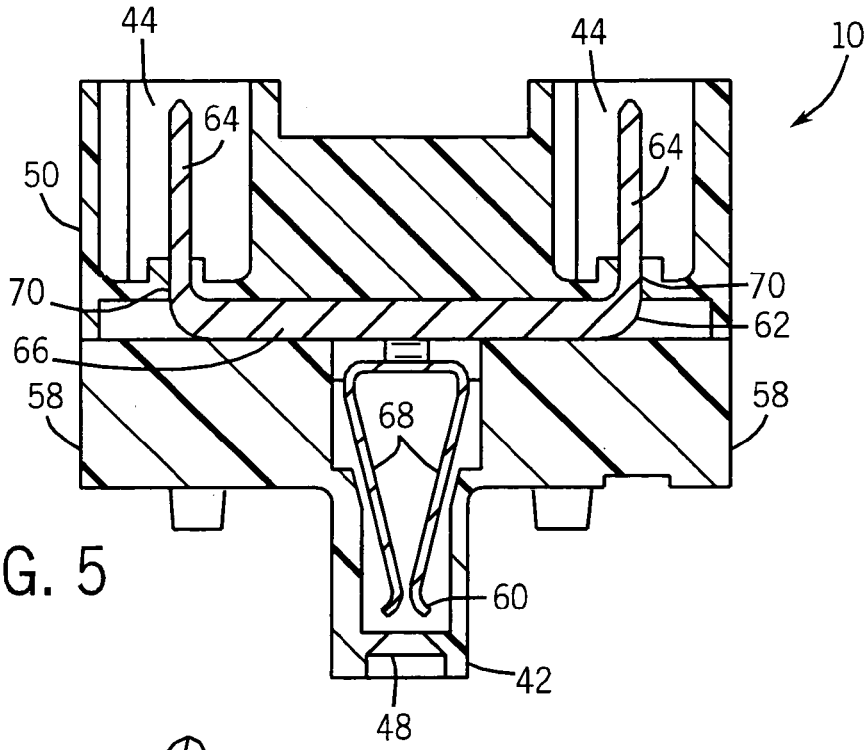
FIG. 5 is a sectional view of the branch connector of FIGS. 2 and 3, illustrating an exemplary layout of the body components and conductors.

FIG. 5 illustrates a typical cross-section through connector 10 as shown in FIG. 4, including through one of the conductive elements 56. The present implementation provides a straightforward and cost-effective design for insuring effective data and power connections through the branch connector 10 via unitary conductive elements disposed within the body base 50 and body cover 58. As shown in FIG. 5, the conductive elements 56 present tips 60 which diverge from one another within plug 42, and particularly within the protective walls 48 of the plug. Branch arms 62 of the conductive elements serve to extend conductive paths into sockets 44, at which point the arms provide extensions 64 for completing electrical connections to device cables. Arms 62 thus comprise a common base 66 which extends generally between the body base 50 and the body cover 58. Adjacent to the base 66, the conductors form spring prongs 68 which terminate at tips 60. Openings 70 in the body base 50 allow for passage of extensions 64 into sockets 44. The form of the body base and body cover, then serve to maintain the conductive elements in proper alignment and isolated from one another within the connector.

Figure 6:
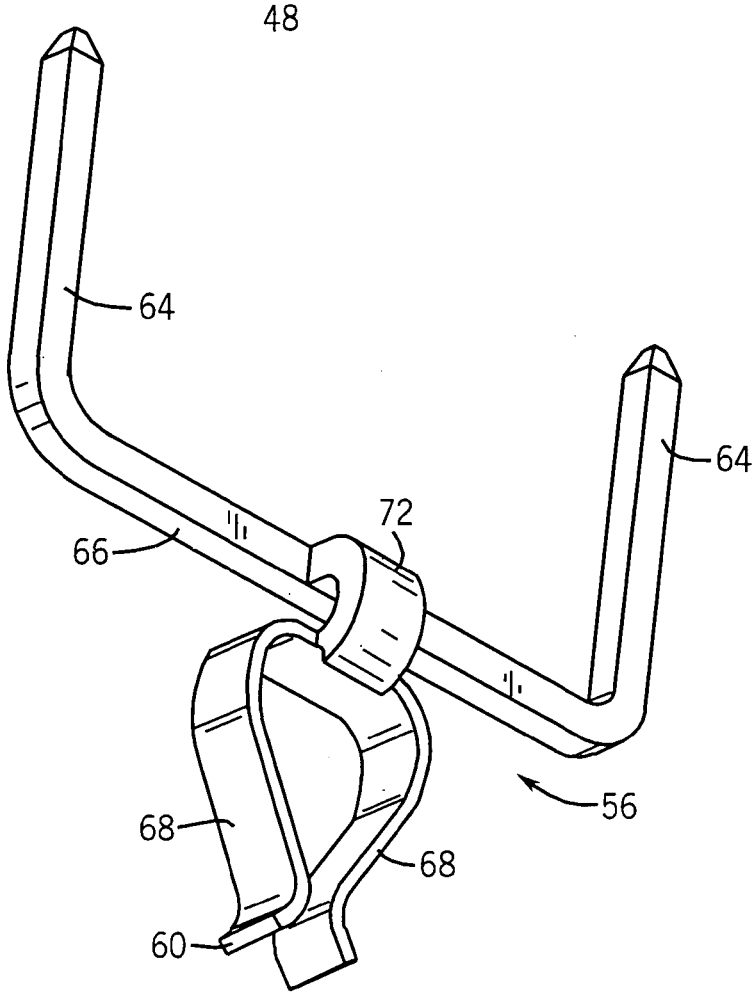
FIG. 6 is a perspective view of an exemplary conductor for the connectors.

FIG. 6 illustrates in somewhat greater detail a presently preferred configuration of conductive elements 56. The arrangement of FIG. 6 allows the conductive elements to be fabricated by stamping and bending operations from a single sheet or plate of material. In particular, in a flat layout, all of elements 64, 66 and 68 may be stamped and subsequently bent into the configuration shown in FIG. 6. To provide good electrical connection between base 66 and spring prong 68, a linking strap 72 is formed which transitions between these elements. The economical configuration, then, of the conductive elements allows for prefabrication of identical elements for the various power and data signal paths, and affords simple fabrication of the branch connector by simply locating and mounting of the conductive elements between the body portions of the connector as described above.

Figure 7A:
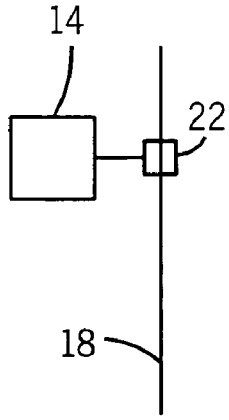
FIGS. 7A–7C are diagrammatical representations of typical applications for the connector system of the present technique.
Figure 7B:
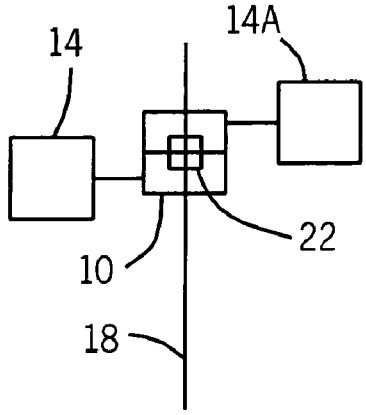
Figure 7C:
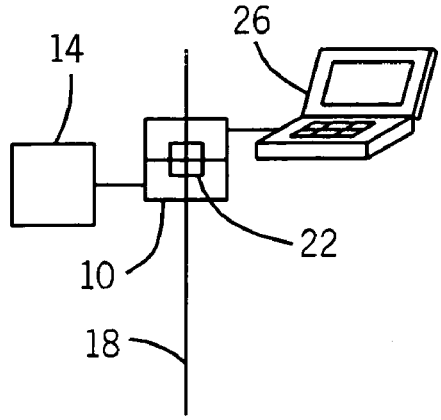

As discussed above, the novel branch connector described offers for expanded connections in existing power and data signal networks. FIGS. 7A–7C illustrate various arrangements which can be accommodated by the branch connector. As shown in FIG. 7A, in a conventional setting, a cable 18 will provide data and power signals through a distribution connector 22. The dedicated connector 22 accommodates a single device 14, such as a networked input or output module, actuator, switchgear, power supply, controller, and so forth. To expand the capacity of the network at connector 22, branch connector 10 is installed as shown in FIG. 7B. The connector is designed to interface with the distribution connector 22 as described above, and may be temporarily or permanently secured to the connector via appropriate fasteners. The original device 14 is thus coupled to one portion of the branch connector 10, while an additional device 14A may be connected to a network via the other portion of the connector.

The connector system also provides for temporary connection of devices to the network as illustrated in FIG. 7C. For example, where network status, configuration, programming, monitoring, logging, and similar operations are needed, temporary connections, such as to laptop computers 26 may be provided via the branch connector 10. In such embodiments, it may be desirable to permanently or semi-permanently connect a device 14 to connector 10, leaving an additional socket open for the temporary device 26. The present technique thus allows for enhanced expansion of the system connection capacity, while avoiding unnecessary interruption of power or data signals to networked devices. Moreover, the connector system allows for such expansion and flexibility in a cost-effective manner, and without requiring rewiring of existing connectors, sockets, panels, or enclosures.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims. For example, while the connectors and system described above may provide for transmission of data and power signals, certain devices may employ only the data or the power signals in their normal function. Power supplies, by way of example, may provide power via the branch connector, but may have no need to access data signals. Similarly, monitoring devices, such as laptop computers, may access data signals only, with no need for drawing network power via the branch connector.

What is claimed is:

1. A system for providing data and power signals from a network to a device, the system comprising:

a connector body having first and second sides;

an orientation-sensitive, multi-conductor plug on the first side, the plug being configured to be inserted into a mating receptacle for transmitting data and power from a network;

a pair of orientation sensitive, multi-conductor receptacles on the second side, each receptacle being configured to receive a mating plug of independently and removably matable device cables for transmitting data and power from the network to a downstream device without interruption of data and power to a device coupled to the other receptacle; and a plurality of conductive elements disposed within the body to define at lease four separate conductive paths between the plug and the receptacles, including two data paths and two power paths.

2. The system of claim 1, wherein the receptacles are configured to receive plugs identical to the plug of the connector.

3. The system of claim 2, wherein the receptacles and plug include extensions of the conductive elements aligned parallel to one another.

4. The system of claim 3, wherein the conductive elements are identical to one another.

5. The system of claim 3, wherein the receptacles and plug include molded features limiting mating with corresponding connectors to a single desired orientation.

6. The system of claim 1, wherein the body comprises mating body sections, and wherein the conductive elements are disposed between the body sections.

7. The system of claim 6, wherein at least one of the body sections includes apertures for receiving fasteners to retain the body in a desired application.

8. The system of claim 1, wherein the plug includes apertures for receiving pins extending within a mating receptacle.

9. The system of claim 8, wherein each receptacle includes pins for mating with a respective plug of a device cable.

10. A system for providing data and power signals from a network to a device, the system comprising:

an orientation-sensitive network receptacle for transmitting data and power from the network;

a connector matable with the receptacle, the connector including a connector body having first and second sides, an orientation-sensitive, multi-conductor plug on the first side, the plug being configured to be inserted into the network receptacle for transmitting data and power from the network, a pair of orientation sensitive, multi-conductor connector receptacles on the second side, the receptacles being configured to receive mating plugs for transmitting data and power from the network to a pair of downstream devices without interruption of data and power to either device, and a plurality of conductive elements disposed within the body to define at least four separate conductive paths between the plug and the receptacles, including two data paths and two power paths; and cable assemblies including plugs independently and removably matable with the connector receptacles for transmitting data and/or power from the network to the pair of downstream devices.

11. The system of claim 10, wherein the connector receptacles are identical in configuration to the network receptacle.

12. The system of claim 10, wherein the connector plug is identical to plugs provided on each cable assembly.

13. The system of claim 10, wherein the receptacles and plug include extensions of the conductive elements aligned parallel to one another.

14. The system of claim 10, wherein the conductive elements are identical to one another.

15. The system of claim 10, wherein the receptacles and plug include molded features limiting mating with corresponding connectors to a single desired orientation.

16. The system of claim 10, wherein the body comprises mating body sections, and wherein the conductive elements are disposed between the body sections.

17. The system of claim 16, wherein at least one of the body sections includes apertures for receiving fasteners to retain the body in a desired application.

18. The system of claim 10, wherein the connector receptacle includes pins for transmitting data and power to the connector, and wherein the connector plug includes apertures for receiving pins extending within the connector receptacle.

19. The system of claim 18, wherein the conductive elements form pins extending within each receptacle of the connector for mating with a respective plug of one of the cable assemblies.

20. A system for providing data and power signals from a network to a device, the system comprising:

a connector body having first and second sides;

an orientation-sensitive, multi-conductor plug on the first side, the plug being configured to be inserted into a mating receptacle for transmitting data and power from a network;

a pair of orientation sensitive, multi-conductor receptacles on the second side, each receptacle being configured to receive a mating plug of independently and removably matable device cables for transmitting data and power from the network to a downstream device without interruption of data and power to a device coupled to the other receptacle, the receptacles being configured to receive plugs identical to the plug of the connector; and a plurality of conductive elements disposed within the body to define at lease four separate conductive paths between the plug and the receptacles, including two data paths and two power paths;

wherein the receptacles are configured to receive plugs identical to the plug of the connector.

* * * * *